US007495623B2

(12) United States Patent
Brist et al.

(10) Patent No.: US 7,495,623 B2
(45) Date of Patent: Feb. 24, 2009

(54) MODULAR WAVEGUIDE INTECONNECT

(76) Inventors: Gary Brist, 8300 NE. Hwy. 240, Yamhill, OR (US) 97148; Bryce Horine, 5251 NW. 126th Ter., Portland, OR (US) 97229; Stephen H. Hall, 1012 34th Pl., Forest Grove, OR (US) 97116; Peter A. Davison, 13712 116th St. Ct. E., Puyallup, WA (US) 98374

( * ) Notice: Subject to any disclaimer, the term of this patent is extended or adjusted under 35 U.S.C. 154(b) by 85 days.

(21) Appl. No.: 11/724,599

(22) Filed: Mar. 15, 2007

(65) Prior Publication Data

US 2008/0224936 A1 Sep. 18, 2008

(51) Int. Cl.
*H01Q 13/00* (2006.01)

(52) U.S. Cl. ..... 343/772; 343/700 MS

(58) Field of Classification Search ..... 343/772, 343/700 MS; 333/26
See application file for complete search history.

(56) References Cited

U.S. PATENT DOCUMENTS 4,167,010 A * 9/1979 Kerr ..... 343/700 MS
6,507,316 B2 * 1/2003 Mendelsohn et al. .. 343/700 MS
7,132,905 B2 * 11/2006 Sano ..... 333/26

* cited by examiner

*Primary Examiner*—Hoang V Nguyen
(74) *Attorney, Agent, or Firm*—Caven & Aghevli LLC

(57) ABSTRACT

In some embodiments, an electronic device comprises a circuit board, an antenna structure on the circuit board, and a waveguide mounted on the circuit board above the antenna structure. Other embodiments may be described.

11 Claims, 4 Drawing Sheets

MODULAR WAVEGUIDE INTECONNECT

BACKGROUND

The subject matter described herein relates generally to the field of electronic devices and more particularly to a modular waveguide.

Traditional methods of transmitting digital data between components on a motherboard (i.e., between a chipset and a processor) employ transmission lines. As data rates increase in proportion to Moore's Law, signals propagating on the transmission line may be attenuated due to the low-pass filter behavior of the structure. At high data rates, the harmonic components of the digital waveform would be so attenuated that the signal may not be recoverable at the receiver. Hence additional signal transmitting techniques may find utility.

BRIEF DESCRIPTION OF THE DRAWINGS

The detailed description is described with reference to the accompanying figures.

DETAILED DESCRIPTION

Figure 1A:
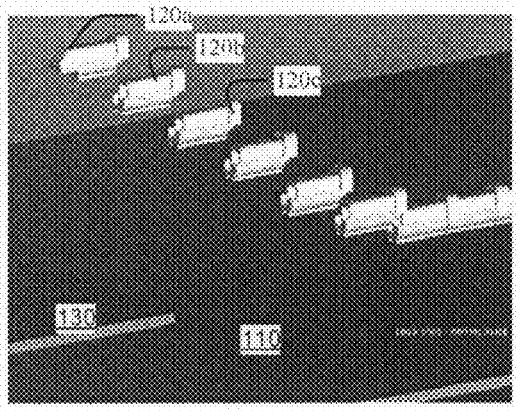
FIGS. 1A-1E are schematic illustrations of a modular waveguide assembly in accordance with some embodiments.

Described herein are exemplary systems and methods for modular waveguides which may be used in, e.g., computing devices. In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

FIGS. 1A-1E schematic illustrations of a modular waveguide assembly in accordance with some embodiments. Referring to FIGS. 1A-1E, modular waveguide assembly, referred to herein generally by reference numeral 120, may be mounted on a circuit board 110 to couple a signal driver 130 to a circuit that receives a signal generated by signal driver 130.

Waveguide assembly 120 comprises a plurality of interlocking segments, 120*a*, 120*b*, 102*c*, etc. Interlocking segments 120*a*, 120*b*, 120*c*, etc., comprise a body having an upper surface, a lower surface, and first and second side surfaces that define an air channel 122, which provides a communication channel. At least one of the segments 120*a* includes an aperture 124 to receive an antenna structure into the air channel 126. At least one of the segments, and in some embodiments all the segments 120*a*, 120*b*, 120*c*, includes a channel 126 which may be filled with a flowable material (e.g., tin or another solder material) to seal the module to a surface of the circuit board 110.

Figure 2A:
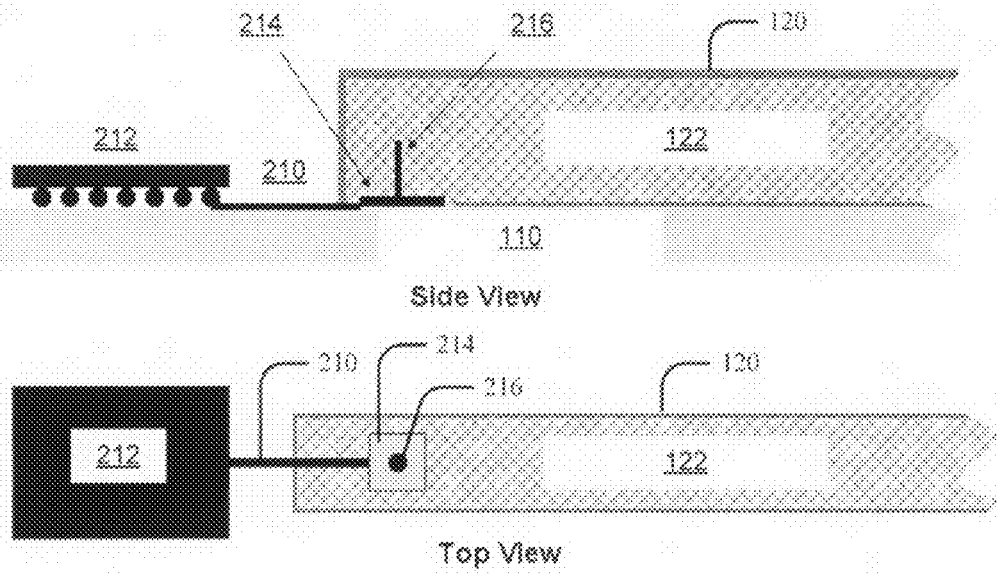
FIGS. 2A-2E are schematic illustrations of a modular waveguide assembly in accordance with some embodiments.
Figure 2B:
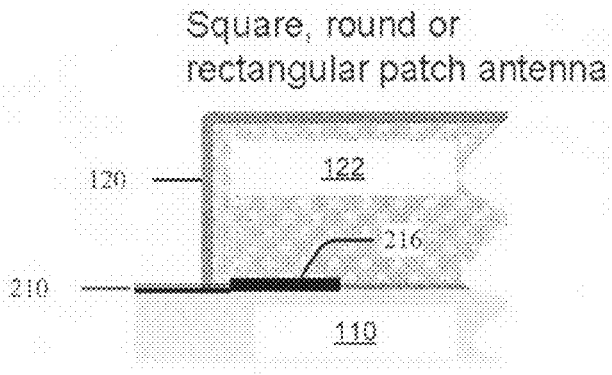

FIGS. 2A-2B are schematic illustrations of a modular waveguide assembly in accordance with some embodiments. Referring to FIGS. 2A-2B, a signal driver 212 drives a signal onto a transmission line 210, which is coupled to an antenna 216. Antenna 216 may be mounted on a surface pad 214. A waveguide assembly 120 my be positioned on circuit board 110 such that antenna 216 extends through the aperture 124 of segment 120*a* into the air channel 122. Thus, signals generated by driver 212 are propagated via transmission line 210 to antenna 216, which propagates the signals as radio frequency (RF) signals through air channel 122.

Figure 2C:
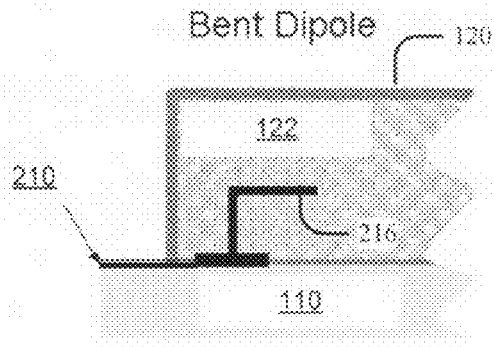
Figure 2D:
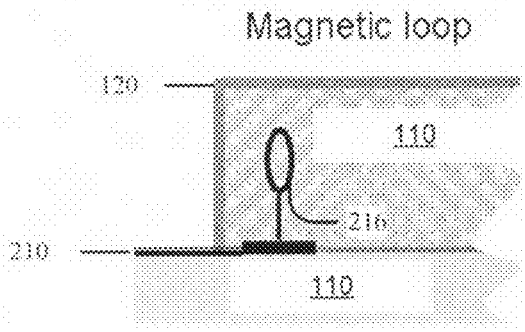
Figure 2E:
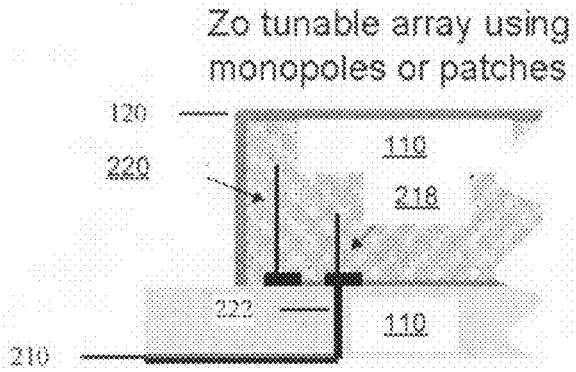

FIG. 2A illustrates a monopole antenna 216. FIGS. 2B-2E depict multiple alternate embodiments of antenna 216. For example, FIG. 2B depicts a patch antenna 216, which may be embodied as a square, round, or rectangular antenna. FIG. 2C depicts a bent dipole antenna 216. FIG. 2D depicts a magnetic loop antenna 216, and FIG. 2E depicts a low impedance tunable antenna array 216, which may be implemented using either a monopole antenna or a patch antenna. In FIG. 2E the transmission line 210 extends along the bottom surface of circuit board 110 through a via 222 in circuit board 110. A reflector 220 may be mounted on the surface of circuit board 110. Alternatively, a portion of the surface of waveguide 120 may be coated with a reflective material to form a reflector.

Figure 3:
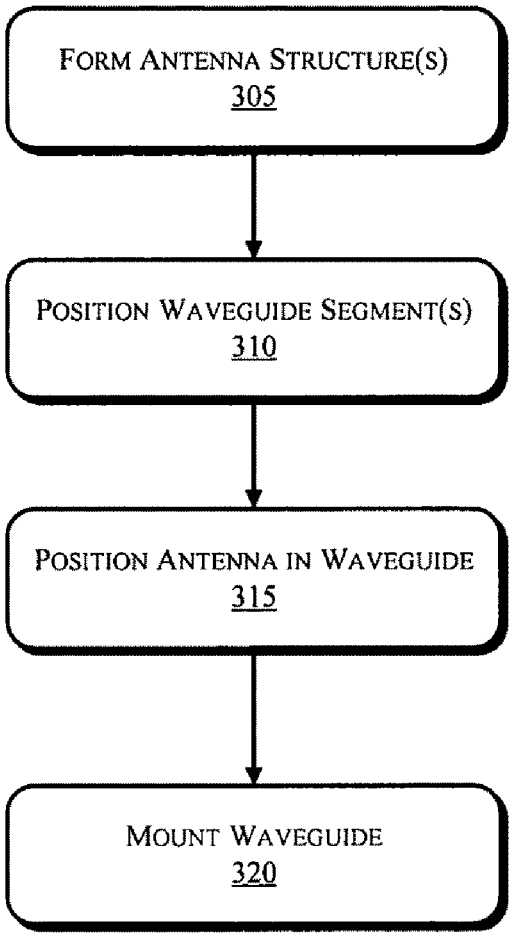
FIG. 3 is a flowchart illustrating a method for making and using a modular waveguide assembly in accordance with some embodiments.

FIG. 3 is a flowchart illustrating a method for making and using a modular waveguide assembly in accordance with some embodiments. Referring to FIG. 3, at operation 305 an antenna structure is formed. In some embodiments the antenna structure may be etched into circuit board 110 or a device on circuit board 110, such as driver 130. In other embodiments the antenna structure may be soldered onto the circuit board 110 or a device on circuit board 110, such as driver 130.

Figure 1B:
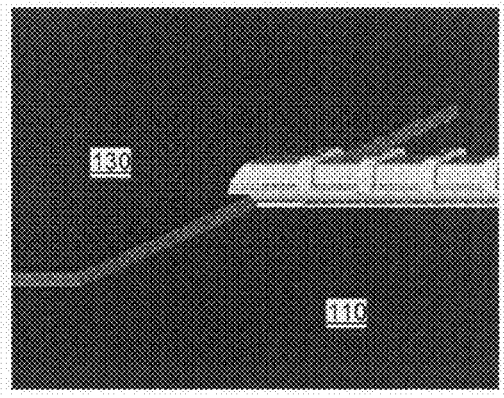
Figure 1C:
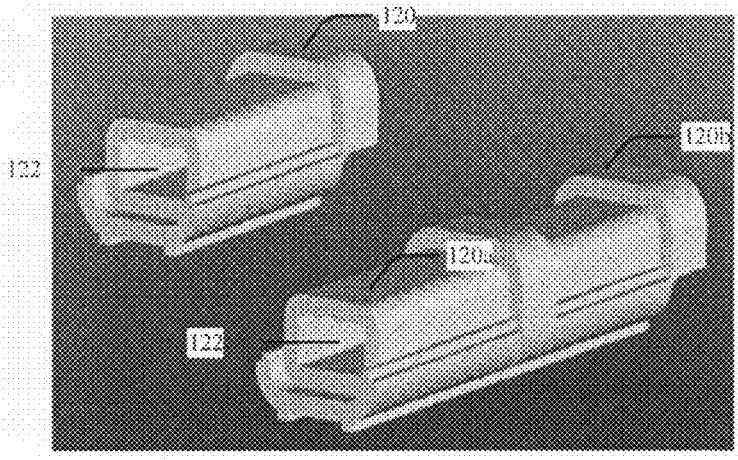
Figure 1D:
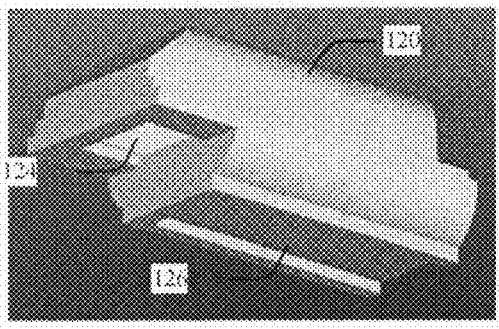
Figure 1E:
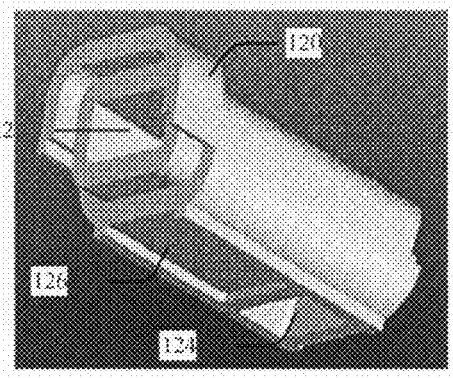

At operation 310 the waveguide segment(s) 120*a*, 120*b*, 120*c* are positioned on the surface of the circuit board 110. For example, the waveguide segments may be positioned on circuit board 110 in an interlocking fashion as depicted in FIGS. 1A and 1B to define a waveguide assembly 120 that forms an air channel 120. At least one segment 120*a* is positioned such that the antenna 216 extends into the air channel 120 (operation 315).

At operation 320 the waveguide is mounted on the circuit board 110. For example, in some embodiments the circuit board 110 may be subjected to heat such that the flowable material on the channel 126 of circuit board segments 120*a*, 120*b*, 120*c* bonds the segments 120*a*, 120*b*, 120*c* to the circuit board 110.

Figure 4:
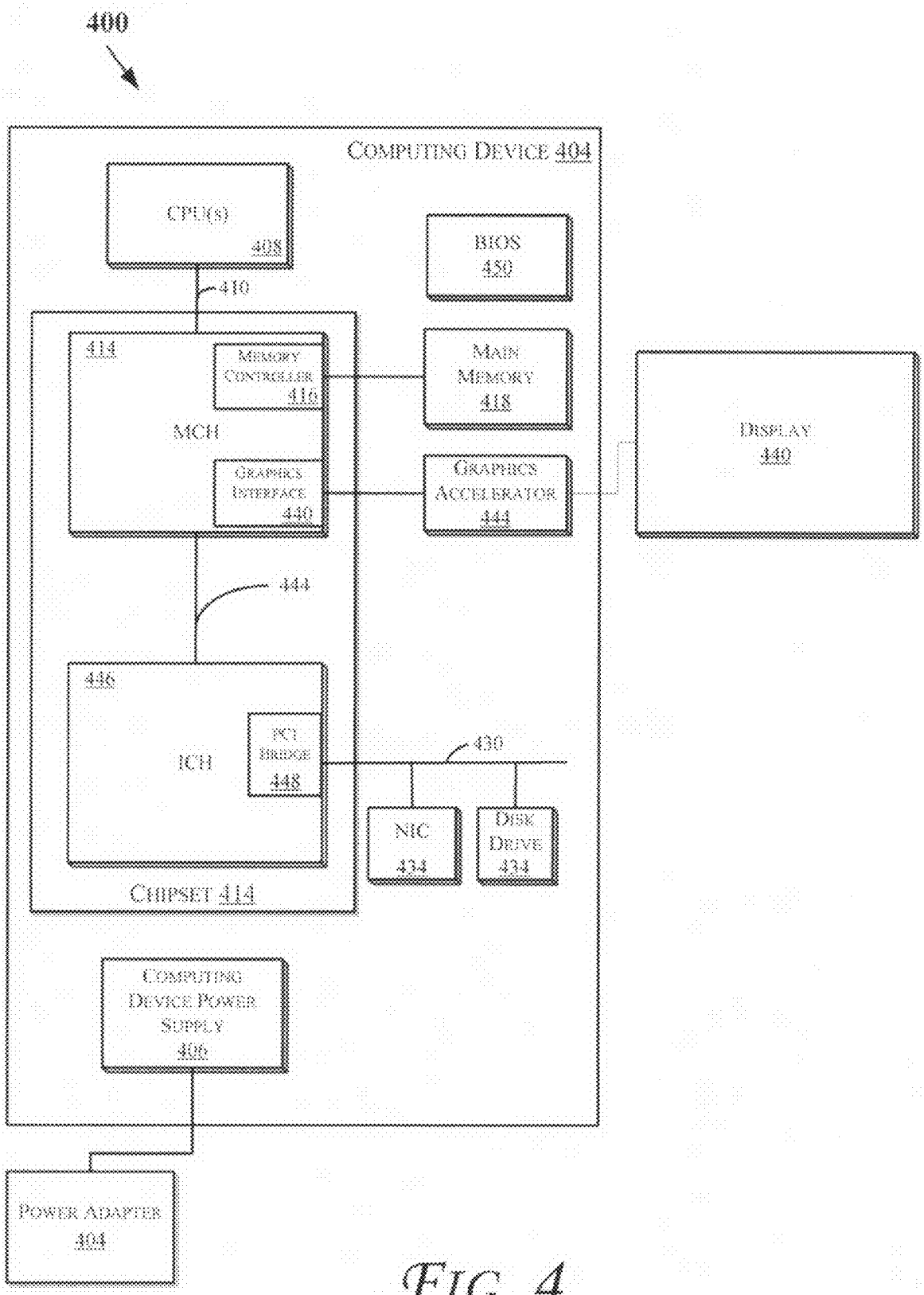
FIG. 4 is a schematic illustration of an architecture of a computer system in accordance with some embodiments.

FIG. 4 is a schematic illustration of an architecture of a computer system adapted to implement semiconductor based host protected addressing in accordance with some embodiments. Computer system 400 includes a computing device 402 and a power adapter 404 (e.g., to supply electrical power to the computing device 402). The computing device 402 may be any suitable computing device such as a laptop (or notebook) computer, a personal digital assistant, a desktop computing device (e.g., a workstation or a desktop computer), a rack-mounted computing device, and the like.

Electrical power may be provided to various components of the computing device 402 (e.g., through a computing device power supply 406) from one or more of the following sources: one or more battery packs, an alternating current (AC) outlet (e.g., through a transformer and/or adaptor such as a power adapter 404), automotive power supplies, airplane power supplies, and the like. In one embodiment, the power adapter 404 may transform the power supply source output (e.g., the AC outlet voltage of about 110 VAC to 240 VAC) to a direct current (DC) voltage ranging between about 7 VDC to 12.6 VDC. Accordingly, the power adapter 404 may be an AC/DC adapter.

The computing device 402 may also include one or more central processing unit(s) (CPUs) 408 coupled to a bus 410. In one embodiment, the CPU 408 may be one or more processors in the Pentium® family of processors including the Pentium® II processor family, Pentium® III processors, Pentium® IV processors available from Intel® Corporation of Santa Clara, Calif. Alternatively, other CPUs may be used, such as Intel's Itanium®, XEON™, and Celeron® processors. Also, one or more processors from other manufactures may be utilized. Moreover, the processors may have a single or multi core design.

A chipset 412 may be coupled to the bus 410. The chipset 412 may include a memory control hub (MCH) 414. The MCH 414 may include a memory controller 416 that is coupled to a main system memory 418. The main system memory 418 stores data and sequences of instructions that are executed by the CPU 408, or any other device included in the system 400. In some embodiments, the main system memory 418 includes random access memory (RAM); however, the main system memory 418 may be implemented using other memory types such as dynamic RAM (DRAM), synchronous DRAM (SDRAM), and the like. Additional devices may also be coupled to the bus 410, such as multiple CPUs and/or multiple system memories.

In some embodiments, main memory 418 may include a one or more flash memory devices. For example, main memory 418 may include either NAND or NOR flash memory devices, which may provide hundreds of megabytes, or even many gigabytes of storage capacity.

The MCH 414 may also include a graphics interface 420 coupled to a graphics accelerator 422. In one embodiment, the graphics interface 420 is coupled to the graphics accelerator 422 via an accelerated graphics port (AGP). In an embodiment, a display (such as a flat panel display) 440 may be coupled to the graphics interface 420 through, for example, a signal converter that translates a digital representation of an image stored in a storage device such as video memory or system memory into display signals that are interpreted and displayed by the display. The display 440 signals produced by the display device may pass through various control devices before being interpreted by and subsequently displayed on the display.

A hub interface 424 couples the MCH 414 to an input/output control hub (ICH) 426. The ICH 426 provides an interface to input/output (I/O) devices coupled to the computer system 400. The ICH 426 may be coupled to a peripheral component interconnect (PCI) bus. Hence, the ICH 426 includes a PCI bridge 428 that provides an interface to a PCI bus 430. The PCI bridge 428 provides a data path between the CPU 408 and peripheral devices. Additionally, other types of I/O interconnect topologies may be utilized such as the PCI Express™ architecture, available through Intel®Corporation of Santa Clara, Calif.

The PCI bus 430 may be coupled to a network interface card (NIC) 432 and one or more disk drive(s) 434. Other devices may be coupled to the PCI bus 430. In addition, the CPU 408 and the MCH 414 may be combined to form a single chip. Furthermore, the graphics accelerator 422 may be included within the MCH 414 in other embodiments.

Additionally, other peripherals coupled to the ICH 426 may include, in various embodiments, integrated drive electronics (IDE) or small computer system interface (SCSI) hard drive(s), universal serial bus (USB) port(s), a keyboard, a mouse, parallel port(s), serial port(s), floppy disk drive(s), digital output support (e.g., digital video interface (DVI)), and the like.

System 400 may further include a basic input/output system (BIOS) 450 to manage, among other things, the boot-up operations of computing system 400. BIOS 450 may be embodied as logic instructions encoded on a memory module such as, e.g., a flash memory module.

In the description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

Reference in the specification to "one embodiment" or "an embodiment" means that a particular feature, structure, or characteristic described in connection with the embodiment is included in at least an implementation. The appearances of the phrase "in one embodiment" in various places in the specification may or may not be all referring to the same embodiment.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. An electronic device, comprising:

a circuit board;

an antenna structure on the circuit board; and a waveguide mounted on the circuit board and coupled to the antenna structure;

wherein the waveguide comprises a plurality of interlocking segments, at least one segment comprising:

a body having an upper surface, a lower surface, and first and second side surfaces that define an air channel, which provides a communication channel.

2. The electronic device of claim 1, wherein the antenna comprises at least one of a monopole antenna, a patch antenna, a bent dipole antenna, a dipole antenna, or a tuneable array antenna.

3. The electronic device of claim 1, wherein the antenna is etched onto the circuit board.

4. The electronic device of claim 1, wherein the antenna is soldered onto the circuit board.

5. The electronic device of claim 1, wherein at least one segment comprises a channel filled with a flowable material to seal the module to a surface of the circuit board.

6. The electronic device of claim 1, wherein the body of at least one segment comprises an aperture to receive an antenna structure into the communication channel.

7. A method, comprising:

forming an antenna structure on a surface of a circuit board; and mounting a waveguide on the surface of the circuit board coupled to the antenna structure;

wherein mounting a waveguide on the surface of the circuit board above the antenna structure comprises inserting the antenna structure into an aperture on the waveguide.

8. The method of claim 7, wherein forming an antenna structure on a surface of a circuit board comprises etching the antenna structure into the circuit board.

9. The method of claim 7, wherein forming an antenna structure on a surface of a circuit board comprises soldering the antenna structure onto the circuit board.

10. The method of claim 7, wherein mounting a waveguide on the surface of the circuit board above the antenna structure comprises flowing a material on a bottom surface of the waveguide to seal the waveguide to the circuit board.

11. The method of claim 7, further comprising coupling the antenna structure to a driver circuit on the circuit board.

* * * * *